US006575250B1

(12) United States Patent
Wijsman

(10) Patent No.: US 6,575,250 B1
(45) Date of Patent: Jun. 10, 2003

(54) EXPANDING A TUBULAR ELEMENT IN A WELLBORE

(75) Inventor: Cornelius Jacobus Wijsman, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/713,279

(22) Filed: Nov. 15, 2000

(30) Foreign Application Priority Data

Nov. 15, 1999 (EP) ..... 99203814

(51) Int. Cl.[7] ..... E21B 43/10
(52) U.S. Cl. ..... 166/380; 166/207
(58) Field of Search ..... 166/207, 380, 166/217, 381, 208, 209, 216

(56) References Cited

U.S. PATENT DOCUMENTS

| | | | |
|---|---|---|---|
| 46,818 | A | 3/1865 | Patterson |
| 341,237 | A | 5/1886 | Healey |
| 958,517 | A | 5/1910 | Mettler |
| 984,449 | A | 2/1911 | Stewart |
| 1,233,888 | A | 7/1917 | Leonard |
| 1,880,218 | A | 10/1932 | Simmons |
| 1,981,525 | A | 11/1934 | Price |
| 2,046,870 | A | 7/1936 | Clasen et al. |
| 2,214,226 | A | 9/1940 | English |
| 2,447,629 | A | 8/1948 | Beissinger et al. |

(List continued on next page.)

FOREIGN PATENT DOCUMENTS

| | | |
|---|---|---|
| CA | 766288 | 6/1966 |
| CA | 771462 | 11/1967 |
| CA | 1171310 | 7/1984 |
| DE | 203767 | 11/1983 |
| DE | 233607 A1 | 3/1986 |
| DE | 278517 A1 | 5/1990 |
| EP | 0633391 A2 | 1/1995 |
| EP | 0823534 | 2/1998 |
| EP | 0881354 | 12/1998 |
| EP | 0881359 | 12/1998 |

(List continued on next page.)

OTHER PUBLICATIONS

Search Report to Application No. GB 0003251.6, Claims Searched 1–5, Jul. 13, 2000.
Search Report to Application No. GB 0004285.3, Claims Searched 2–3, 8–9, 13–16, Jan. 17, 2001.
Search Report to Application No. GB 0005399.1, Claims Searched 25–29, Feb. 15, 2001.
Search Report to Application No. GB 9930398.4, Claims Searched 1–35, Jun. 27, 2000.
International Search Report, Application No. PCT/US00/30022, Oct. 31, 2000.
International Search Report, Application No. PCT/US01/19014, Jun. 12, 2001.

*Primary Examiner*—David Bagnell
*Assistant Examiner*—Jennifer R. Dougherty

(57) ABSTRACT

A method of expanding a tubular element in a borehole formed in an earth formation is provided. The method includes installing the tubular element at a selected location in the borehole, installing a pulling string in the borehole, the pulling string extending in longitudinal direction through the tubular element and having an upper part connected to a pulling device at surface and a lower part provided with an expander of outer diameter larger than the inner diameter of the tubular element, the expander being arranged below at least part of the tubular element to be expanded, the upper part being connected to the lower part by a connector allowing rotation of the upper part relative to the lower part about the longitudinal axis of the pulling string; and pulling the expander through the at least part of the tubular element by operating the pulling device so as to pull the pulling string in upward direction, while simultaneously rotating the upper part relative to said lower part.

5 Claims, 1 Drawing Sheet

U.S. PATENT DOCUMENTS

| | | | |
|---|---|---|---|
| 2,583,316 | A | 1/1952 | Bannister |
| 2,734,580 | A | 2/1956 | Layne |
| 2,796,134 | A | 6/1957 | Binkley |
| 2,812,025 | A | 11/1957 | Teague et al. |
| 2,907,589 | A | 10/1959 | Knox |
| 3,067,819 | A | 12/1962 | Gore |
| 3,104,703 | A | 9/1963 | Rike et al. |
| 3,111,991 | A | 11/1963 | Neal |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,412,565 | A | * 11/1968 | Lindsey et al. |
| 3,419,080 | A | 12/1968 | Lebourg |
| 3,424,244 | A | 1/1969 | Kinley |
| 3,477,506 | A | 11/1969 | Malone |
| 3,489,220 | A | 1/1970 | Kinley |
| 3,498,376 | A | 3/1970 | Sizer et al. |
| 3,568,773 | A | 3/1971 | Chancellor |
| 3,669,190 | A | 6/1972 | Sizer et al. |
| 3,687,196 | A | 8/1972 | Mullins |
| 3,691,624 | A | 9/1972 | Kinley |
| 3,693,717 | A | 9/1972 | Wuenschel |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley, et al. |
| 3,780,562 | A | 12/1973 | Kinley |
| 3,785,193 | A | 1/1974 | Kinley et al. |
| 3,797,259 | A | 3/1974 | Kammerer, Jr. |
| 3,812,912 | A | 5/1974 | Wuenschel |
| 3,818,734 | A | 6/1974 | Bateman |
| 3,887,006 | A | 6/1975 | Pitts |
| 3,935,910 | A | 2/1976 | Gaudy et al. |
| 3,945,444 | A | 3/1976 | Knudson |
| 3,948,321 | A | 4/1976 | Owen et al. |
| 3,977,473 | A | 8/1976 | Page, Jr. |
| 3,997,193 | A | 12/1976 | Tsuda et al. |
| 4,069,573 | A | 1/1978 | Rogers, Jr. et al. |
| 4,076,287 | A | 2/1978 | Bill et al. |
| 4,096,913 | A | 6/1978 | Kenneday et al. |
| 4,098,334 | A | 7/1978 | Crowe |
| 4,190,108 | A | 2/1980 | Webber |
| 4,205,422 | A | 6/1980 | Hardwick |
| 4,253,687 | A | 3/1981 | Maples |
| RE30,802 | E | 11/1981 | Rogers, Jr. |
| 4,359,889 | A | 11/1982 | Kelly |
| 4,363,358 | A | 12/1982 | Ellis |
| 4,368,571 | A | 1/1983 | Cooper, Jr. |
| 4,391,325 | A | 7/1983 | Baker et al. |
| 4,393,931 | A | 7/1983 | Muse et al. |
| 4,407,681 | A | 10/1983 | Ina et al. |
| 4,411,435 | A | 10/1983 | McStravick |
| 4,413,682 | A | 11/1983 | Callihan et al. |
| 4,420,866 | A | 12/1983 | Mueller |
| 4,421,169 | A | 12/1983 | Dearth et al. |
| 4,423,889 | A | 1/1984 | Weise |
| 4,423,986 | A | 1/1984 | Skogberg |
| 4,429,741 | A | 2/1984 | Hyland |
| 4,440,233 | A | 4/1984 | Baugh et al. |
| 4,483,399 | A | 11/1984 | Colgate |
| 4,485,847 | A | 12/1984 | Wentzell |
| 4,501,327 | A | 2/1985 | Retz |
| 4,505,017 | A | 3/1985 | Schukei |
| 4,511,289 | A | 4/1985 | Herron |
| 4,526,232 | A | 7/1985 | Hughson et al. |
| 4,553,776 | A | 11/1985 | Dodd |
| 4,576,386 | A | 3/1986 | Benson et al. |
| 4,590,995 | A | 5/1986 | Evans |
| 4,592,577 | A | 6/1986 | Ayres et al. |
| 4,605,063 | A | 8/1986 | Ross |
| 4,611,662 | A | 9/1986 | Harrington |
| 4,629,218 | A | 12/1986 | Dubois |
| 4,632,944 | A | 12/1986 | Thompson |
| 4,634,317 | A | 1/1987 | Skogberg et al. |
| 4,635,333 | A | 1/1987 | Finch |
| 4,637,436 | A | 1/1987 | Stewart, Jr. et al. |
| 4,660,863 | A | 4/1987 | Bailey et al. |
| 4,662,446 | A | 5/1987 | Brisco et al. |
| 4,669,541 | A | 6/1987 | Bissonnette |
| 4,685,191 | A | 8/1987 | Mueller et al. |
| 4,685,834 | A | 8/1987 | Jordan |
| 4,711,474 | A | 12/1987 | Patrick |
| 4,730,851 | A | 3/1988 | Watts |
| 4,739,916 | A | 4/1988 | Ayres et al. |
| 4,793,382 | A | 12/1988 | Szalvay |
| 4,817,710 | A | 4/1989 | Edwards et al. |
| 4,817,716 | A | 4/1989 | Taylor et al. |
| 4,830,109 | A | 5/1989 | Wedel |
| 4,865,127 | A | 9/1989 | Koster |
| 4,913,758 | A | 4/1990 | Koster |
| 4,934,312 | A | 6/1990 | Koster et al. |
| 4,941,512 | A | 7/1990 | McParland |
| 4,941,532 | A | 7/1990 | Hurt et al. |
| 4,968,184 | A | 11/1990 | Reid |
| 4,971,152 | A | 11/1990 | Koster et al. |
| 4,976,322 | A | 12/1990 | Abdrakhmanov et al. |
| 4,981,250 | A | 1/1991 | Persson |
| 5,014,779 | A | 5/1991 | Meling et al. |
| 5,031,699 | A | 7/1991 | Artynov et al. |
| 5,040,283 | A | 8/1991 | Pelgrom |
| 5,052,483 | A | 10/1991 | Hudson |
| 5,083,608 | A | 1/1992 | Abdrakhmanov et al. |
| 5,093,015 | A | 3/1992 | Oldiges |
| 5,107,221 | A | 4/1992 | Nguyen et al. |
| 5,119,661 | A | 6/1992 | Abdrakhmanov et al. |
| 5,156,043 | A | 10/1992 | Ose |
| 5,174,376 | A | 12/1992 | Singeetham |
| 5,197,553 | A | 3/1993 | Leturno |
| 5,209,600 | A | 5/1993 | Koster |
| 5,226,492 | A | 7/1993 | Solaeche P. et al. |
| 5,286,393 | A | 2/1994 | Oldiges et al. |
| 5,318,122 | A | 6/1994 | Murray et al. |
| 5,318,131 | A | 6/1994 | Baker |
| 5,325,923 | A | 7/1994 | Surjaatmadja et al. |
| 5,332,038 | A | 7/1994 | Tapp et al. |
| 5,335,736 | A | 8/1994 | Windsor |
| 5,337,808 | A | 8/1994 | Graham |
| 5,337,823 | A | 8/1994 | Nobileau |
| 5,346,007 | A | 9/1994 | Dillon et al. |
| 5,348,087 | A | 9/1994 | Williamson, Jr. |
| 5,348,095 | A | 9/1994 | Worrall et al. |
| 5,348,668 | A | 9/1994 | Oldiges et al. |

5,360,292 A 11/1994 Allen et al.
5,361,843 A 11/1994 Shy et al.
5,366,010 A 11/1994 Zwart
5,366,012 A 11/1994 Lohbeck
5,368,075 A 11/1994 Bäro et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,425,559 A 6/1995 Nobileau
5,426,130 A 6/1995 Thurber et al.
5,435,395 A 7/1995 Connell
5,439,320 A 8/1995 Abrams
5,454,419 A 10/1995 Vloedman
5,467,822 A 11/1995 Zwart
5,472,055 A 12/1995 Simson et al.
5,494,106 A 2/1996 Gueguen et al.
5,507,343 A 4/1996 Carlton et al.
5,535,824 A 7/1996 Hudson
5,536,422 A 7/1996 Oldiges et al.
5,606,792 A 3/1997 Schafer
5,613,557 A 3/1997 Blount et al.
5,617,918 A 4/1997 Cooksey et al.
5,664,327 A 9/1997 Swars
5,667,011 A * 9/1997 Gill et al. ..... 166/295
5,667,252 A 9/1997 Schafer et al.
5,685,369 A 11/1997 Ellis et al.
5,695,008 A 12/1997 Bertet et al.
5,718,288 A 2/1998 Bertet et al.
5,785,120 A 7/1998 Smalley et al.
5,787,933 A 8/1998 Russ et al.
5,791,419 A 8/1998 Valisalo
5,794,702 A 8/1998 Nobileau
5,829,520 A 11/1998 Johnson
5,829,524 A 11/1998 Flanders et al.
5,833,001 A 11/1998 Song et al.
5,857,524 A 1/1999 Harris et al.
5,875,851 A 3/1999 Vick, Jr. et al.
5,885,941 A 3/1999 Sateva et al.
5,901,789 A 5/1999 Donnelly et al.
5,918,677 A 7/1999 Head
5,924,745 A 7/1999 Campbell
5,944,107 A 8/1999 Ohmer
5,951,207 A 9/1999 Chen
5,957,195 A 9/1999 Bailey et al.
5,979,560 A 11/1999 Nobileau
5,984,369 A 11/1999 Crook et al.
5,984,568 A 11/1999 Lohbeck
6,012,522 A 1/2000 Donnelly et al.
6,012,523 A * 1/2000 Campbell et al. ..... 166/277
6,012,874 A 1/2000 Groneck et al.
6,017,168 A 1/2000 Fraser, Jr. et al.
6,021,850 A 2/2000 Wood et al.
6,029,748 A 2/2000 Forsyth et al.
6,044,906 A 4/2000 Saltel
6,047,505 A 4/2000 Willow
6,050,341 A 4/2000 Metcalf
6,056,059 A 5/2000 Ohmer
6,065,500 A 5/2000 Metcalfe
6,070,671 A 6/2000 Cumming et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,135,208 A 10/2000 Gano et al.
6,142,230 A 11/2000 Smalley et al.
6,226,855 B1 5/2001 Maine
,002,626 A1 6/2001 Frank et al
6,250,385 B1 6/2001 Montaron
6,263,968 B1 7/2001 Freeman et al.
6,283,211 B1 9/2001 Vloedman
6,315,043 B1 11/2001 Farrant et al.

FOREIGN PATENT DOCUMENTS

EP 0899420 3/1999
EP 0937861 8/1999
EP 0952305 10/1999
EP 0952306 10/1999
FR 2717855 A1 9/1995
FR 2741907 A1 6/1997
FR 2771133 A 5/1999
FR 2780751 1/2000
GB 557823 12/1943
GB 961750 6/1964
GB 1111536 5/1968
GB 350833 9/1972
GB 1448304 9/1976
GB 607950 5/1978
GB 612004 5/1978
GB 620582 7/1978
GB 641070 1/1979
GB 909114 5/1979
GB 1563740 3/1980
GB 2058877 A 4/1981
GB 832049 5/1981
GB 853089 8/1981
GB 874952 10/1981
GB 599850 1/1982
GB 894169 1/1982
GB 907220 2/1982
GB 953172 8/1982
GB 959878 9/1982
GB 976019 11/1982
GB 976020 11/1982
GB 989038 1/1983
GB 1002514 3/1983
GB 1041671 A 9/1983
GB 2115860 A 9/1983
GB 1051222 A 10/1983
GB 1086118 A 4/1984
GB 1158400 A 5/1985
GB 1212575 A 2/1986
GB 1250637 A1 8/1986
GB 1411434 7/1988
GB 1430498 A1 10/1988
GB 1432190 A1 10/1988
GB 2216926 A 10/1989
GB 1601330 A1 10/1990
GB 1627663 A2 2/1991
GB 1659621 A1 6/1991
GB 1663179 A2 7/1991
GB 1677225 A1 9/1991
GB 1677248 A1 9/1991
GB 1686123 A1 10/1991
GB 1686124 A1 10/1991
GB 1686125 A1 10/1991
GB 2243191 A 10/1991
GB 1698413 A1 12/1991
GB 1710694 A 2/1992
GB 1730429 A1 4/1992
GB 1745873 A1 7/1992
GB 1747673 A1 7/1992
GB 1749267 A1 7/1992
GB 2256910 A 12/1992
GB 1786241 A1 1/1993
GB 1804543 A3 3/1993
GB 1818459 A1 5/1993

| | | | |
|---|---|---|---|
| GB | 1295799 | A1 | 2/1995 |
| GB | 2305682 | A | 4/1997 |
| GB | 1663180 | A1 | 7/1997 |
| GB | 2322655 | A | 9/1998 |
| GB | 2326896 | A | 1/1999 |
| GB | 2329916 | A | 4/1999 |
| GB | 2329918 | A | 4/1999 |
| GB | 2336383 | A | 10/1999 |
| GB | 2343691 | A | 5/2000 |
| GB | 2344606 | A | 6/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| JP | 208458 | | 10/1985 |
| JP | 6475715 | | 11/1986 |
| JP | 102875 | | 4/1995 |
| JP | 94068 | | 4/2000 |
| JP | 107870 | | 4/2000 |
| JP | 162192 | | 6/2000 |
| NL | 9001081 | | 12/1991 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 113267 | B1 | 5/1998 |
| RU | 2144128 | C1 | 1/2000 |
| WO | 8100132 | | 1/1981 |
| WO | 9005598 | | 3/1990 |
| WO | 9201859 | | 2/1992 |
| WO | 9208875 | | 5/1992 |
| WO | 9325799 | | 12/1993 |
| WO | 9325800 | | 12/1993 |
| WO | 9421887 | | 9/1994 |
| WO | 9425655 | | 11/1994 |
| WO | 9503476 | | 2/1995 |
| WO | 9601937 | | 1/1996 |
| WO | 9621083 | | 7/1996 |
| WO | 9626350 | | 8/1996 |
| WO | 9637681 | | 11/1996 |
| WO | 9706346 | | 2/1997 |
| WO | 9711306 | | 3/1997 |
| WO | 9717524 | | 5/1997 |
| WO | 9717526 | | 5/1997 |
| WO | 9717527 | | 5/1997 |
| WO | 9720130 | | 6/1997 |
| WO | 9721901 | | 6/1997 |
| WO | 9800626 | | 1/1998 |
| WO | 9807957 | | 2/1998 |
| WO | 9809053 | | 3/1998 |
| WO | 9822690 | | 5/1998 |
| WO | 9826152 | | 6/1998 |
| WO | 9842947 | | 10/1998 |
| WO | 9849423 | | 11/1998 |
| WO | 9902818 | | 1/1999 |
| WO | 9904135 | | 1/1999 |
| WO | 9906670 | | 2/1999 |
| WO | 9908827 | | 2/1999 |
| WO | 9908828 | | 2/1999 |
| WO | 9918328 | | 4/1999 |
| WO | 9923354 | | 5/1999 |
| WO | 9925524 | | 5/1999 |
| WO | 9925951 | | 5/1999 |
| WO | 9935368 | | 7/1999 |
| WO | 9943923 | | 9/1999 |
| WO | 0001926 | | 1/2000 |
| WO | 0004271 | | 1/2000 |
| WO | 0008301 | | 2/2000 |
| WO | 0026500 | | 5/2000 |
| WO | 0026501 | | 5/2000 |
| WO | 0026502 | | 5/2000 |
| WO | 0031375 | | 6/2000 |
| WO | 0037767 | | 6/2000 |
| WO | 0037768 | | 6/2000 |
| WO | 0037771 | | 6/2000 |
| WO | 0037772 | | 6/2000 |
| WO | 0039432 | | 7/2000 |
| WO | 0046484 | | 8/2000 |
| WO | 0050727 | | 8/2000 |
| WO | 0050732 | | 8/2000 |
| WO | 0050733 | | 8/2000 |
| WO | 0077431 | A2 | 12/2000 |

* cited by examiner

EXPANDING A TUBULAR ELEMENT IN A WELLBORE

FIELD OF THE INVENTION

The present invention relates to a method of expanding a tubular element in a borehole formed in an earth formation.

BACKGROUND TO THE INVENTION

In the technology of borehole drilling for the exploitation of hydrocarbon fluids, the borehole is generally provided with a casing or liner to prevent collapse of the borehole wall. It has already been tried to apply radially expandable casings or liners, whereby the casing/liner is lowered into the borehole and thereafter radially expanded by pulling an expander through the casing/liner. One of the advantages of such procedure is that there is no longer a need for the conventional nested arrangement of borehole casings of stepwise decreasing diameter. However it has appeared that the pulling force necessary to pull the expander through the casing/liner can be prohibitively high.

It is an object of the invention to provide an improved method of expanding a tubular element in a borehole formed in an earth formation, whereby the pulling forces needed to pull an expander through the tubular element are reduced.

SUMMARY OF THE INVENTION

In accordance with the invention there is provided a method of expanding a tubular element in a borehole formed in an earth formation, the method comprising:

installing the tubular element at a selected location in the borehole;

installing a pulling string in the borehole, the pulling string extending in longitudinal direction through the tubular element and having an upper part connected to a pulling device at surface and a lower part provided with an expander of outer diameter larger than the inner diameter of the tubular element, the expander being arranged below at least part of the tubular element to be expanded, the upper part being connected to the lower part by a connector allowing rotation of the upper part relative to the lower part about the longitudinal axis of the pulling string; and pulling the expander through said at least part of the tubular element by operating the pulling device so as to pull the pulling string in upward direction, and simultaneously rotating the upper part of the pulling string relative to the lower part thereof.

By simultaneously pulling the string and rotating the upper part of the string it is achieved that the longitudinal component of friction between the string and the borehole wall or tubular element, is significantly reduced or even eliminated. Consequently the pulling force no longer needs to counteract said longitudinal friction component.

BRIEF DESCRIPTION OF THE FIGURES

The invention will be further described in more detail and with reference to the accompanying drawing in which FIG. 1 schematically shows an embodiment of a pull string used in application of the method according to the invention.

DESCRIPTION OF A PREFERRED EMBODIMENT

Figure 1:
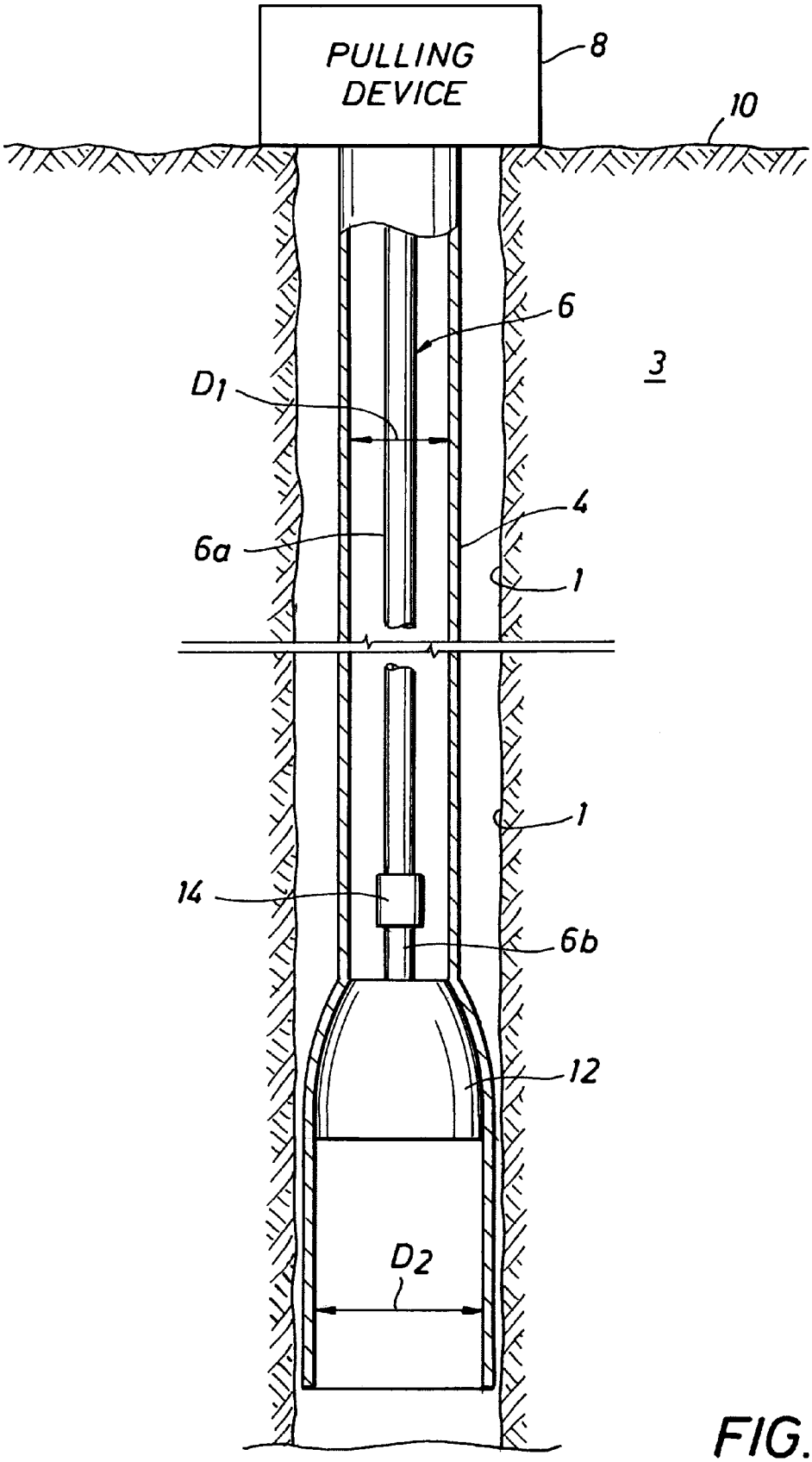

In FIG. 1 is shown a borehole 1 formed in an earth formation 3. A tubular casing 4 having an initial internal diameter D1 is installed in the borehole 1 to a selected depth. The casing 4 extends from the selected depth to surface (as shown in FIG. 1). Alternatively the casing 4 extends from the selected depth to a location below surface. A pulling string in the form of a drill string 6 having a longitudinal fluid passage (not shown) extends through the borehole 1 and into the casing 4, the drill string 6 having an upper part 6*a* connected to a pulling device 8 arranged at the earth surface 10 and a lower part 6*b* connected to an expander 12. The expander 12 has a frustoconical shape with an upper end of diameter slightly smaller than $D_1$ and a lower end of diameter $D_2$ larger than $D_1$. Furthermore the expander 12 is provided with a first latching device (not shown) for temporarily latching the expander 12 to the lower end of the casing 4, and with a second latching device (not shown) for latching the lower end of the drill string 6 to the expander 12. The pulling device 8 is capable of pulling the drill string 6 in upward direction through the borehole 1.

The upper part 6*a* of the drill string 6 is connected to the lower part 6*b* thereof by a connector in the form of a clutch 14 operable in an engaged mode in which the clutch 14 prevents rotation of the upper part 6*a* relative to the lower part 6*b* about the longitudinal axis of the drill string 6, and a disengaged mode in which the clutch 14 allows rotation of the upper part 6*a* relative to the lower part 6*b* about said longitudinal axis. The clutch 14 can be controlled to switch between the engaged mode and the disengaged mode by selected pressure pulses induced in a body of fluid present in the fluid passage of the drill string 6, or by any other control means, for example electrical control means.

During normal operation the expander 12 is latched to the lower end of the casing 4, and the casing 4 with the expander latched thereto is lowered through the borehole 1 until the lower end of the casing arrives at the selected depth whereupon the casing 4 is anchored to the borehole. Next the drill string 6 is lowered through the casing 4 until the lower end of the drill string 6 latches to the expander 12, whereby during lowering of the drill string 6 the clutch 14 is in the engaged mode. The clutch 14 is then switched to the disengaged mode, and the upper part 6*a* of the drill string 6 is rotated while simultaneously the pulling device 8 is operated so as to pull the drill string 6 in upward direction through the borehole 1. The expander 12 is thereby unlatched from the lower end of the casing 4 and is pulled through the casing 4 in upward direction thereby expanding the casing 4 to inner diameter $D_2$.

By simultaneously pulling the drill string 6 and rotating the upper part 6*a* thereof it has been achieved that the pulling force necessary to pull the string through the borehole is significantly reduced by virtue of a reduction of (or the absence of) the longitudinal component of the friction between the upper part 6*a* and the casing/borehole wall.

I claim:

1. A method of expanding a tubular element in a borehole formed in an earth formation, the method comprising:

installing the tubular element at a selected location in the borehole;

installing a pulling string in the borehole, the pulling string extending in longitudinal direction through the tubular element and having an upper part connected to a pulling device at surface and a lower part provided with an expander of outer diameter larger than the inner diameter of the tubular element, the expander being arranged below at least part of the tubular element to be expanded, the upper part being connected to the lower part by a connector allowing rotation of the upper part relative to the lower part about the longitudinal axis of the pulling string; and pulling the expander through said at least part of the tubular element by operating the pulling device so as to pull the pulling string in upward direction, and simultaneously rotating said upper part relative to said lower part.

2. The method of claim 1, wherein the connector is arranged adjacent the expander.

3. The method of claim 1, wherein the connector is selectively operable in an engaged mode wherein said rotation of the upper part relative to the lower part is prevented, and a disengaged mode wherein said rotation of the upper part relative to the lower part is allowed.

4. The method of claim 1 wherein said tubular element is selected from a wellbore casing, a wellbore screen and a wellbore liner.

5. The method of claim 1 wherein the pulling string is a drill string for drilling the borehole.

* * * * *